US008779335B2

(12) United States Patent
Saito

(10) Patent No.: US 8,779,335 B2
(45) Date of Patent: Jul. 15, 2014

(54) IMAGE HEATING APPARATUS

(75) Inventor: Shutaro Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 13/445,369

(22) Filed: Apr. 12, 2012

(65) Prior Publication Data

US 2012/0273478 A1 Nov. 1, 2012

(30) Foreign Application Priority Data

Apr. 28, 2011 (JP) ..... 2011-101455

(51) Int. Cl.
*B21B 27/06* (2006.01)
*G03G 15/20* (2006.01)

(52) U.S. Cl.
CPC .... *G03G 15/2067* (2013.01); *G03G 2215/0125* (2013.01)
USPC ..... 219/469; 219/471; 399/67

(58) Field of Classification Search
USPC ..... 219/469–71, 216, 549; 399/67–70, 399/328–335
See application file for complete search history.

(56) References Cited

U.S. PATENT DOCUMENTS

2010/0196039 A1 8/2010 Ono

FOREIGN PATENT DOCUMENTS

| | | | |
|---|---|---|---|
| JP | 58-125077 | * | 7/1983 |
| JP | 58-125077 | A | 7/1983 |
| JP | 2006-184366 | A | 7/2006 |
| JP | 2007-079064 | A | 3/2007 |
| JP | 2010-181469 | A | 8/2010 |

OTHER PUBLICATIONS

European Search Report dated Feb. 22, 2013, in European Application No. 12165441.2-1560 / 2518572.
European Search Report dated Aug. 24, 2012, in European Application No. 12165441.2-2216.

* cited by examiner

*Primary Examiner* — Shawntina Fuqua
(74) *Attorney, Agent, or Firm* — Fitzpatrick, Cella, Harper & Scinto

(57) ABSTRACT

An image heating apparatus includes first rotatable member and second rotatable member; a heater provided in the second rotatable member; a moving mechanism for integrally moving the second rotatable member and the heater between a contact position in which the second rotatable member is contacted to the first rotatable member and a separation position in which the second rotatable member is separated from the first rotatable member; and an electrical connecting piece for electrically connecting an electric energy supplying portion of the heater and an electric wire under pressure application. A direction of the electrical connecting piece is set so that a smaller angle formed between a longitudinal direction of the electrical connecting piece in cross section of the electric wire and a movement direction of the electrical connecting piece during an operation by the moving mechanism is 45 degrees or less.

19 Claims, 10 Drawing Sheets

(a)

(b)

(a)

(b)

(a)

(b)

(a)

(b)

IMAGE HEATING APPARATUS

FIELD OF THE INVENTION AND RELATED ART

The present invention relates to an image heating apparatus capable of forming and eliminating a heating nip for a recording material by moving a belt or a roller. Specifically, the present invention relates to a structure in which a connectivity of a connecting portion between an electrode member and an external bundle wire which are provided so as to fix their positional relation a rotation center axis of a moving roller or a moving supporting roller.

An image forming apparatus in which a toner image is formed and transferred onto the recording material and thereafter is heated and pressed in the heating nip of the image heating apparatus (fixing device) while nip-conveying the recording material, thereby to fix the image on the recording material has been used widely. Further, an image forming apparatus in which the recording material on which an image which is temporarily or completely fixed is nip-conveyed in the heating nip of the image heating apparatus (glossiness treating device to adjust a surface property of the recording material has also been put into practical use. In the image heating apparatus, a first rotatable member (belt or roller) and a second rotatable member (belt or roller) are press-contacted to each other to form the heating nip for the recording material, and at least one of the first rotatable member and the second rotatable member is moved in a contact-and-separation direction to enable formation and elimination of the heating nip for the recording material.

In Japanese Laid-Open Patent Application (JP-A) 2010-181469, an image heating apparatus in which a pressing roller in which a lamp heater is provided at its rotation center axis is provided movably toward and away from a fixing roller in which a lamp heater is provided at its rotation center axis is disclosed. In this image heating apparatus, the heating nip is eliminated, and the fixing roller and the pressing roller are kept on stand-by in a state in which these rollers are temperature-controlled at different surface temperatures, and then the heating nip for the recording material is formed by causing the pressing roller to be press-contacted to the fixing roller immediately before the recording material is conveyed.

In JP-A 2007-79064, an image heating apparatus in which a pressing roller in which a lamp heater is provided at a rotation center axis is provided movably toward and away from a fixing belt which is heated by electromagnetic induction heating is disclosed.

In JP-A 2006-184366, an image heating apparatus in which two lamp heaters are provided in parallel to a rotation center axis of a fixing roller is disclosed. By controlling the two lamp heaters different in distribution of a heat generation amount with respect to a longitudinal direction, temperature uniformity of the fixing roller with respect to the longitudinal direction is enhanced.

In the image heating apparatus disclosed in JP-A 2010-181469, as shown in FIG. 2, the following problem as to a connection form of electric wires arose.

A lamp heater 104 is provided along a rotation center axis of a pressing roller 102 provided so as to be movable upward and downward. Both ends of the lamp heater 104 are exposed to a considerably high temperature and therefore a heat-resistant bundle wire (wire hardness) 106 is connected to a terminal (electrical connecting piece) of the lamp heater 104 by using a heat-resistant crimp electrical connecting piece.

In such a state, when the pressing roller is repeatedly moved upward and downward every one sheet of image formation, the number of times the bundle wire 106 which is considerably oxidized is folded at a connecting portion with the crimp electrical connecting piece is increased, with the result that a lifetime of the connecting portion becomes short.

SUMMARY OF THE INVENTION

A principal object of the present invention is to provide an image heating apparatus capable of ensuring a long lifetime of a connecting portion of a bundle wire with an electrical connecting piece portion by enhancing an anti-folding performance of the connecting portion of the bundle wire with the electrical connecting piece portion even when a second rotatable member is repeatedly subjected to reciprocal movement.

Another object of the present invention is to provide an image heating apparatus capable of prolonging a lifetime of a connecting portion for connecting a heater and an electric wire.

According to an aspect of the present invention, there is provided an image heating apparatus comprising: first rotatable member and second rotatable member which form a nip in which an image on a recording material to be heated; a heater provided in the second rotatable member; a moving mechanism for integrally moving the second rotatable member and the heater between a contact position in which the second rotatable member is contacted to the first rotatable member and a separation position in which the second rotatable member is separated from the first rotatable member; and an electrical connecting piece for electrically connecting an electric energy supplying portion of the heater and an electric wire under pressure application, wherein a direction of the electrical connecting piece is set so that a smaller angle formed between a longitudinal direction of the electrical connecting piece in cross section of the electric wire and a movement direction of the electrical connecting piece during an operation by the moving mechanism is 45 degrees or less.

These and other objects, features and advantages of the present invention will become more apparent upon a consideration of the following description of the preferred embodiments of the present invention taken in conjunction with the accompanying drawings.

Figure 3:
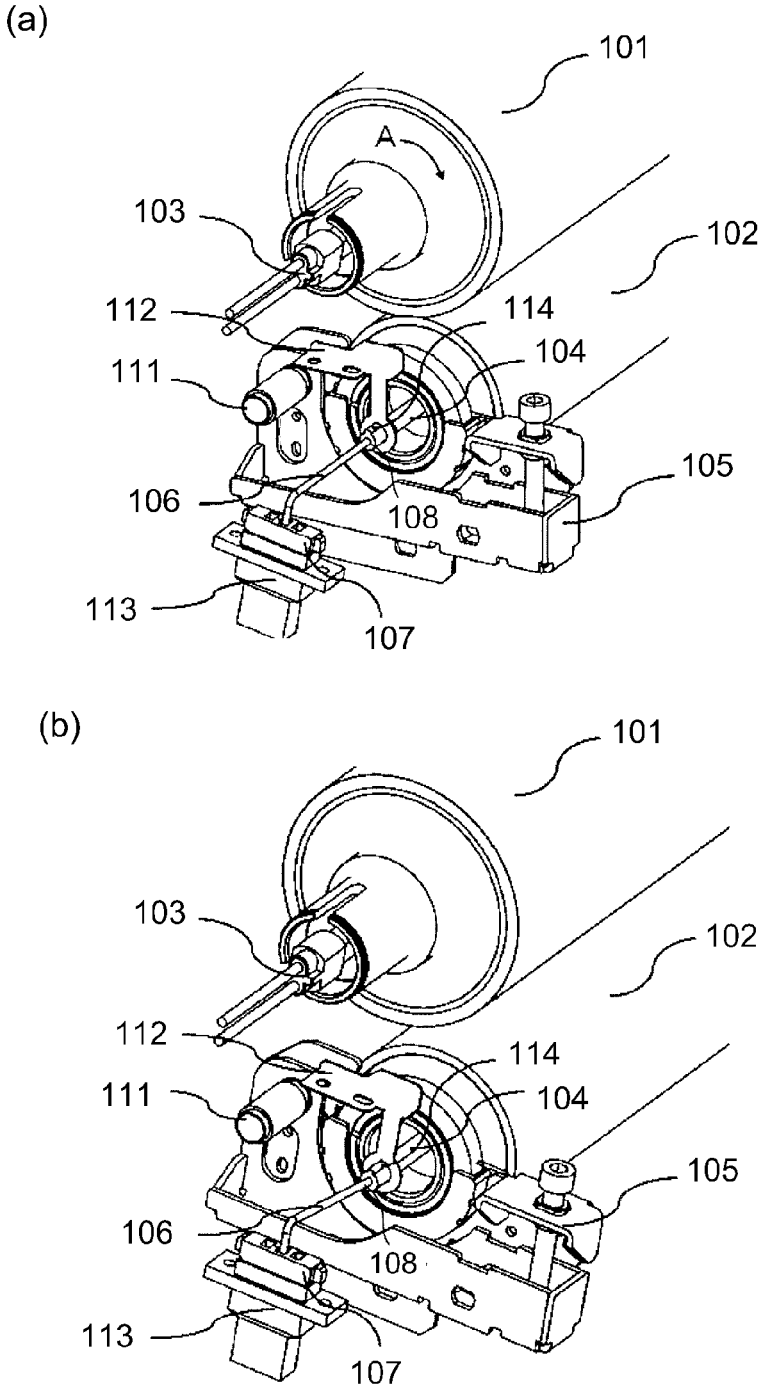

Parts (a) and (b) of FIG. 3 are perspective views of a wiring structure at a roller end portion.

Figure 4:
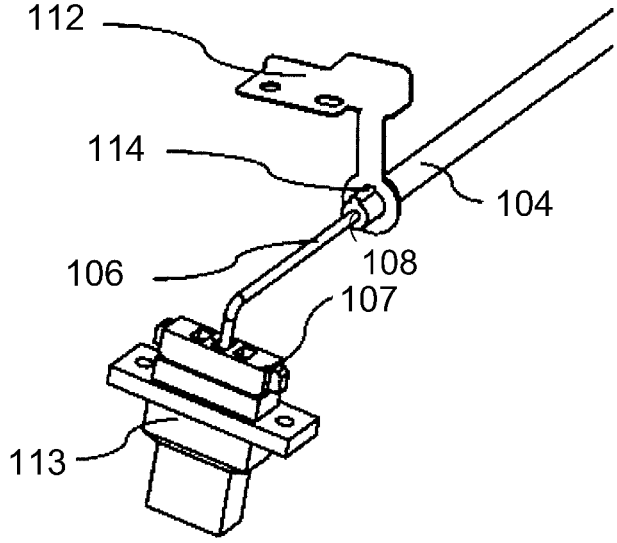
Figure 4:
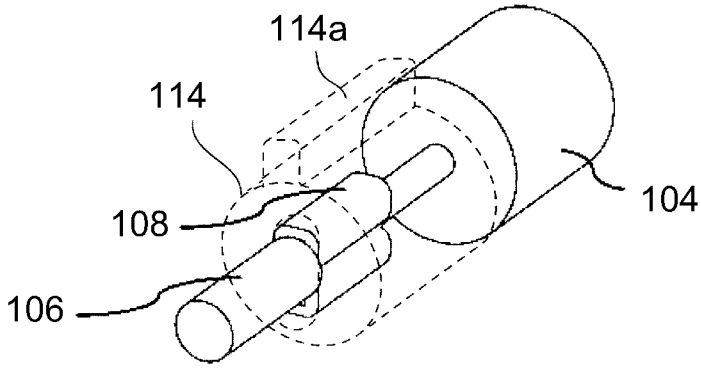

Parts (a) and (b) of FIG. 4 are illustrations of a structure of a connecting portion between a halogen lamp heater and a bundle wire.

Figure 5:
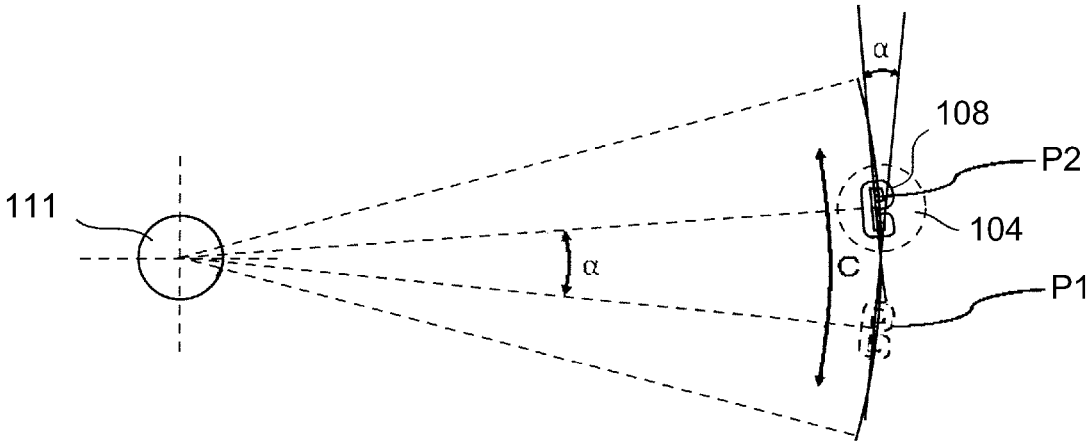
Figure 5:
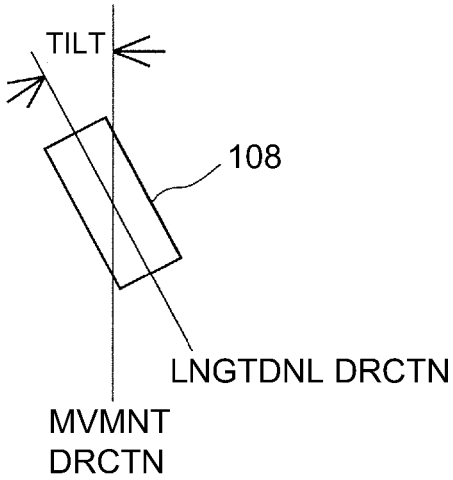

Parts (a) and (b) of FIG. 5 are illustrations of a change in attitude of a heater electrical connecting piece with contact and separation of a pressing roller.

Figure 6:
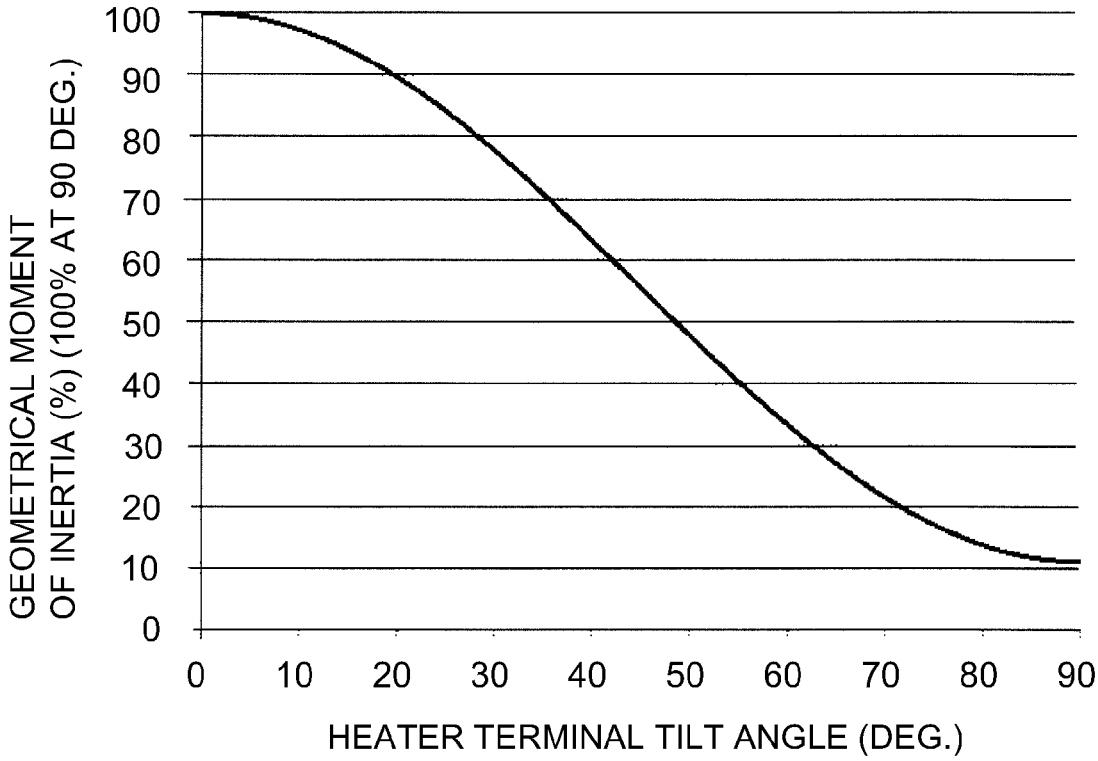

FIG. 6 is a graph showing a relationship between a tilt angle of a heater electrical connecting piece and a geometrical moment of inertia of a crimped bundle wire.

Figure 7:
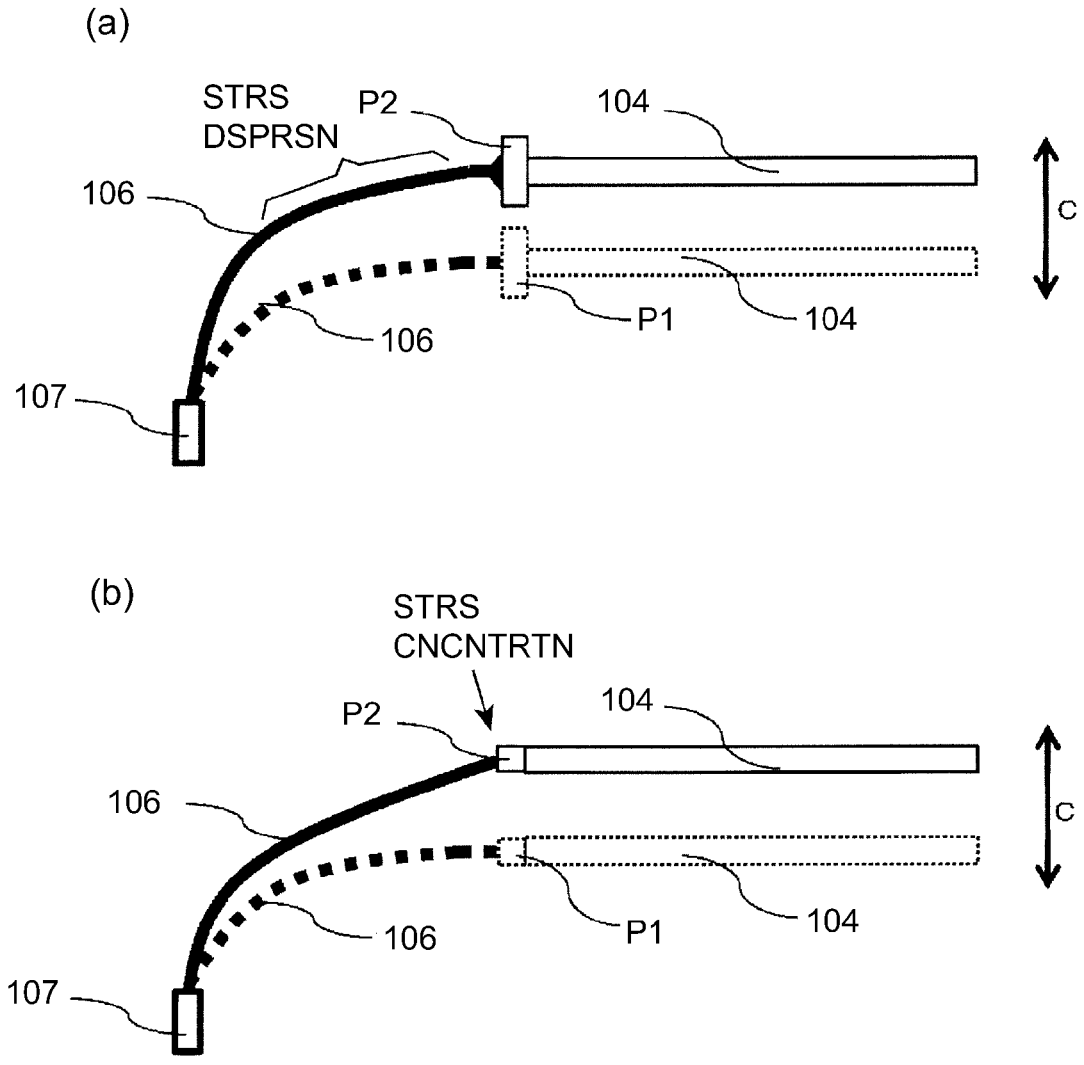

Parts (a) and (b) of FIG. 7 are illustrations each showing a relationship between stress concentration and the geometrical moment of inertia of the crimped bundle wire.

Figure 8:
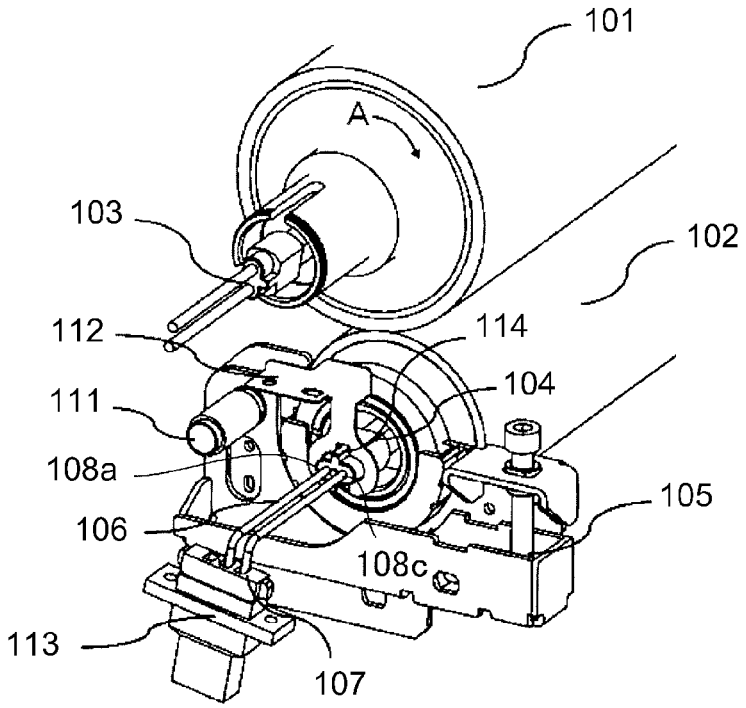
Figure 8:
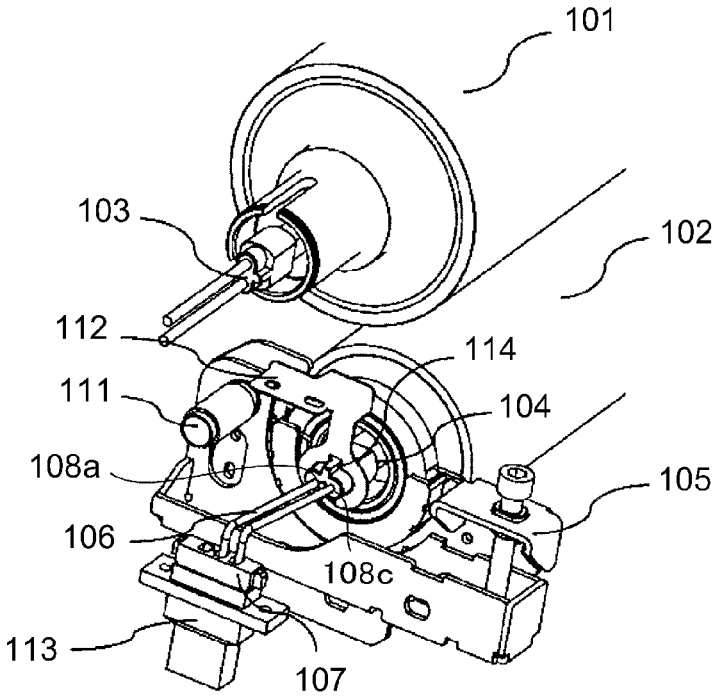

Parts (a) and (b) of FIG. 8 are perspective views of a wiring structure at a roller end portion in Embodiment 2.

Figure 9:
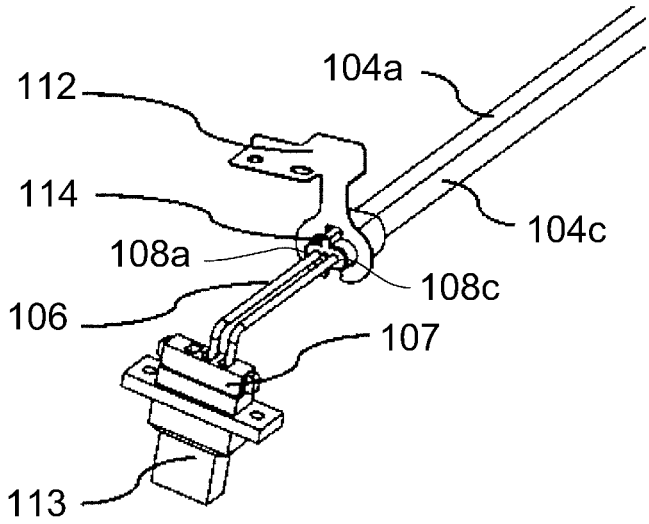
Figure 9:
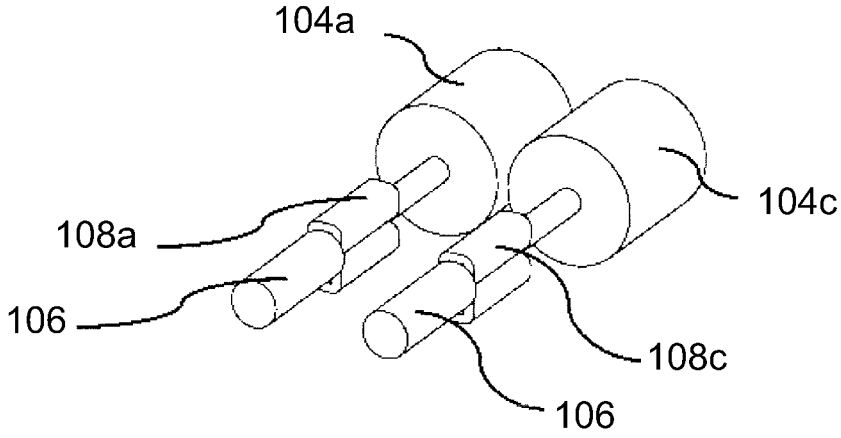

Parts (a) and (b) of FIG. 9 are illustrations of a structure of a connecting portion between a halogen lamp heater and a bundle wire in Embodiment 2.

Figure 10:
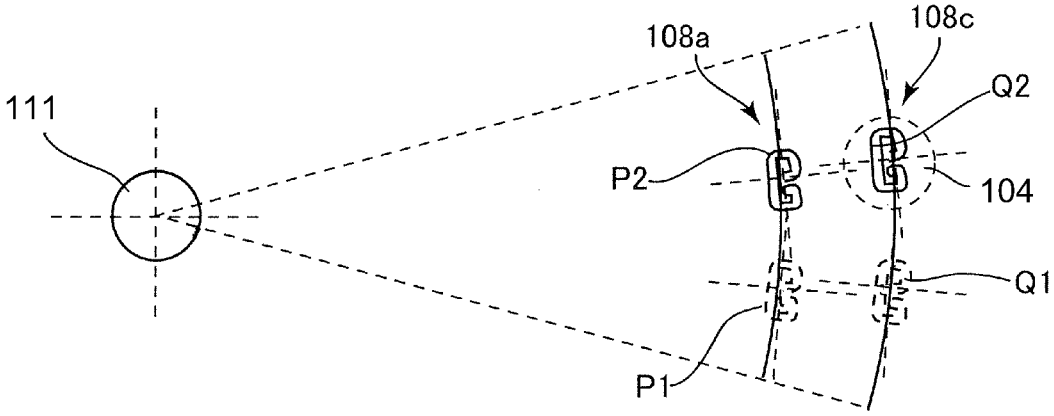

FIG. 10 is an illustration of a change in attitude of a heater electrical connecting piece with contact and separation of a pressing roller in Embodiment 2.

DESCRIPTION OF THE PREFERRED EMBODIMENTS

Hereinbelow, embodiments of the present invention will be described in detail with reference to the drawings. The present invention can be carried out also in other embodiments in which a part or all of constitutions of the respective embodiments are replaced by their alternative constitutions so long as a bending (folding) direction of wiring leads of a movable roller member is regulated in a longitudinal direction in crimp cross section.

Therefore, the present invention is not limited to an image heating apparatus using a halogen lamp heater but can also be carried out in image heating apparatuses using resistance heating and electromagnetic heating. The present invention can also be carried out in not only a roller heating type image heating apparatus in which a pair of roller members is directly press-contacted to each other to form a heating nip but also an image heating apparatus of a belt heating type or belt conveyance type in which at least one of members is connected by a belt member supported by a roller member.

Image Forming Apparatus

Figure 1:
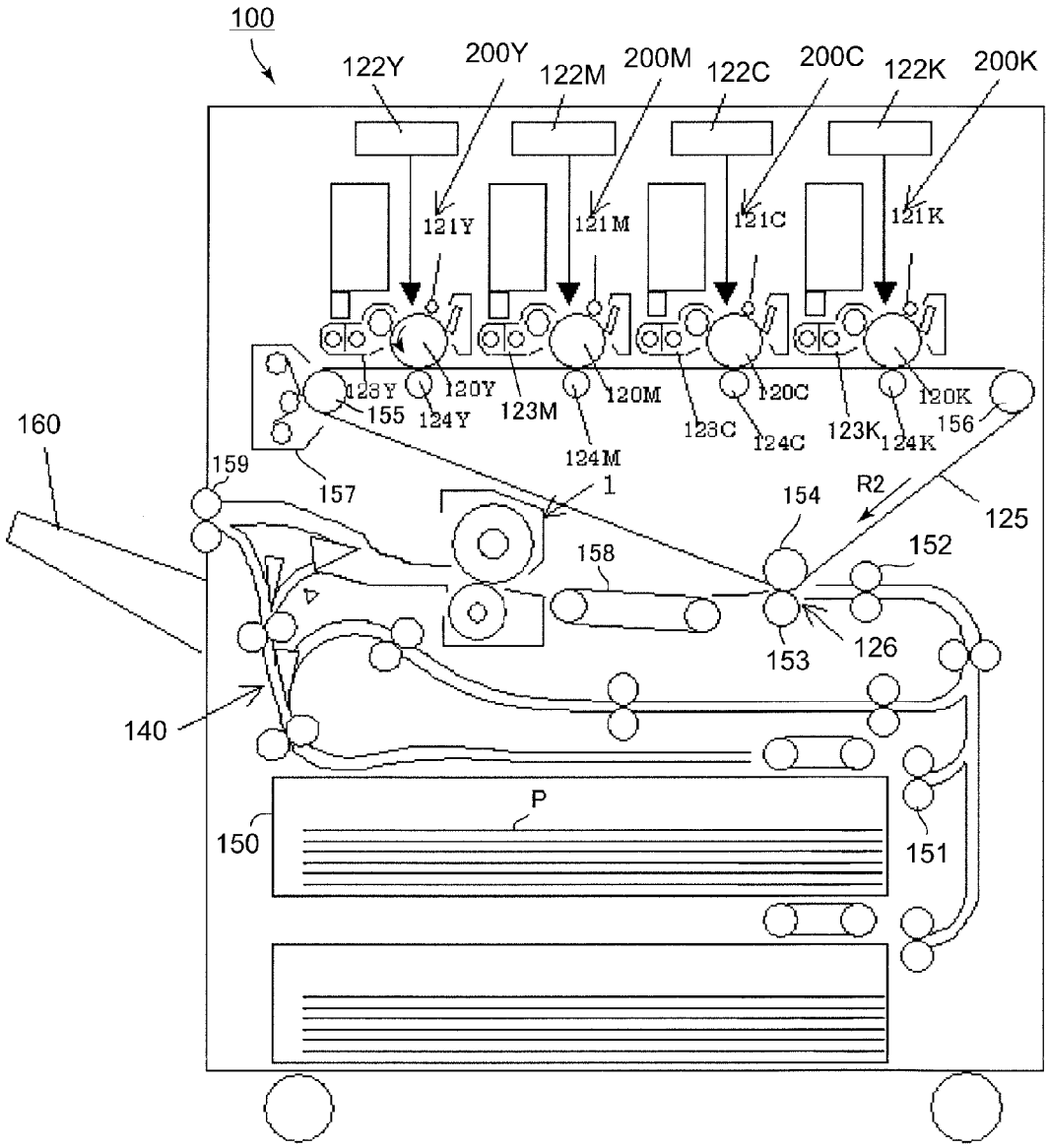
FIG. 1 is an illustration of a general structure of an image forming apparatus.

FIG. 1 is an illustration of a general structure of an image forming apparatus.

As shown in FIG. 1, an image forming apparatus 100 is a tandem-type full-color printer a an intermediary transfer type in which image forming portions 200Y, 200M, 200C and 200K for yellow, magenta, cyan and black, respectively, are arranged along an intermediary transfer belt 125.

In the image forming portion 200Y, a yellow toner image is formed on a photosensitive drum 120Y and then is transferred onto the intermediary transfer belt 125. In the image forming portion 200M, a magenta toner image is formed on a photosensitive drum 120M and is transferred onto the intermediary transfer belt 125. In the image forming portions 200C and 200K, a cyan toner image and a black toner image are formed on photosensitive drums 120C and 120D, respectively, and are transferred onto the intermediary transfer belt 125. The four color toner images transferred on the intermediary transfer belt 125 are conveyed to a secondary transfer portion T2 where they are transferred onto a recording material P.

The recording material P pulled out from a recording material cassette 150 is separated one by one by a separation roller 151 and awaits between registration rollers 152 and is sent toward the secondary transfer portion T2 by the registration rollers 152. The recording material P on which the toner images are secondary-transferred is conveyed into a fixing device 1 by a conveying belt 158 and is, after being subjected to heating and pressure application to fix the toner images thereon, discharged on a tray 160 outside the printer by discharging rollers 159.

Incidentally, in the case where both-side printing is carried out, the recording material P is conveyed in a both-side conveying path 140 and then is conveyed again to the secondary transfer portion T2 in an upside-down state, so that toner images are transferred onto a surface of the recording material P opposite from the surface for first time. Then, similarly as in the case of the first time, the recording material P is conveyed into the fixing device 1, in which the toner images are fixed on the surface of the recording material P.

Further, in the case of a monochromatic image forming apparatus, only the image forming portion 200K is operated, so that the toner image formed on the intermediary transfer belt 125 is transferred onto the recording material P.

The image forming portions 200Y, 200M<200C and 200K have the same constitution except that the colors of toners used in developing devices 123, 123M, 123C and 123K are different from each other. In the following description, the image forming portion 200Y will be described and with respect to other image forming portions 200M, 200C and 200K, the suffix Y of reference numerals (symbols) for representing constituent members (means) of the image forming portion 200Y is to be read as M, C and K, respectively, for explanation of associated ones of the constituent members.

The image forming portion 200Y includes the photosensitive drum 120Y. Around the photosensitive drum 120Y, a charging roller 121Y, an exposure device 122Y, the developing device 123Y, a primary transfer roller 124Y, and a drum cleaning device are disposed in the image forming portion 200Y. The photosensitive drum 120Y is constituted by an aluminum cylinder on which a photosensitive layer is formed at an outer peripheral surface of the aluminum cylinder and is rotated in a direction of an indicated arrow at a predetermined process speed. To the charging roller 121Y, an oscillating voltage in the form of a DC voltage based with an AC voltage is applied, so that the surface of the photosensitive drum 120Y is electrically charged uniformly to a potential.

The exposure device 122Y writes (forms) an electrostatic image for an image on the photosensitive drum 120Y by scanning of the photosensitive drum surface through a rotating mirror with a laser beam.

The developing device 123Y develops the electrostatic image with a two-component developer containing a toner and a carrier, so that the toner image is formed on the photosensitive drum 120Y.

The primary transfer roller 124Y urges an inner surface of the intermediary transfer belt 125 to form a primary transfer portion between the photosensitive drum 120Y and the intermediary transfer belt 125. To the primary transfer roller 124Y, a DC voltage is applied, so that the toner image on the photosensitive drum 120Y is primary-transferred onto the intermediary transfer belt 125. The drum cleaning device rubs the photosensitive drum 120Y with a cleaning blade, so that a transfer residual toner on the photosensitive drum 120Y is collected.

The intermediary transfer belt 125 is stretched around a tension roller 155, a driving roller 156 and an opposite roller 154. A predetermined tension is applied to the intermediary transfer belt 125 by the tension roller 155, and the intermediary transfer belt 125 is rotationally driven by the driving roller 156. A belt cleaning device 157 rubs the intermediary transfer belt 125 with a cleaning blade to collect a transfer residual toner on the intermediary transfer belt 125.

Fixing Device

Figure 2:
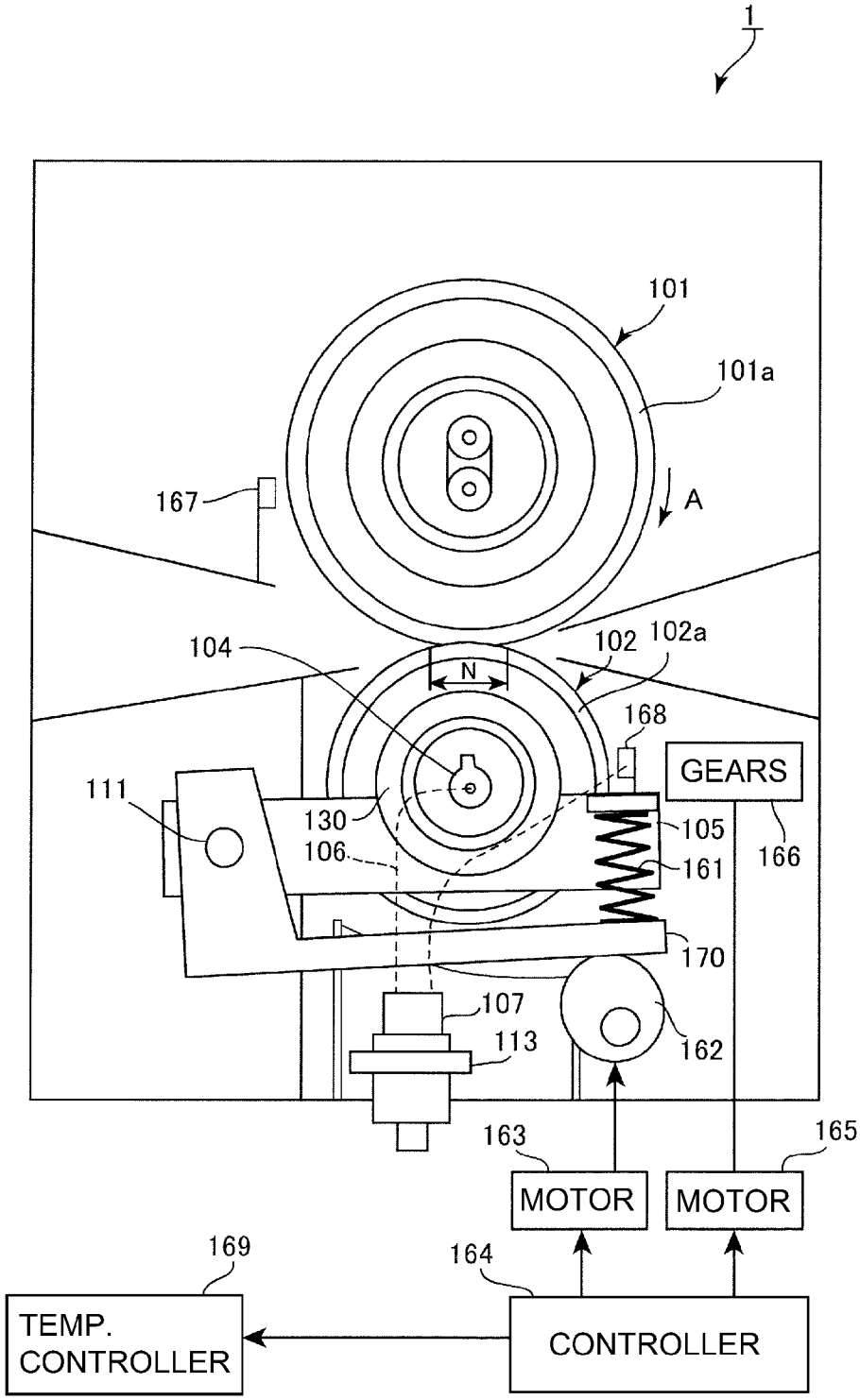
FIG. 2 is an illustration of a structure of a fixing device.

FIG. 2 is an illustration of a structure of the fixing device 1. Parts (a) and (b) of FIG. 3 are perspective views of a wiring structure at a roller end portion. As shown in FIG. 1, in the image forming apparatus 100, the electrostatic image formed on the photosensitive drum 120Y is developed into the toner image and then the toner image is transferred onto the recording material P by using an electrostatic force. Then, in the fixing device 1, the toner image is heated and pressed to be fixed on the surface of the recording material P, so that the image is formed on the recording material P. The fixing device 1 employs a roller-fixing type in which a pressing roller is press-contacted to a fixing roller, in which a heater is provided, to form a heating nip N in which fixing is effected. In the fixing device mounted in the image forming apparatus, the roller-fixing type is employed in many cases.

As shown in FIG. 2, a fixing roller 101 as an example of a first rotatable member heats the image on the recording material. A halogen lamp heater 104 as an example of a heater which is an example of a heating device heats a pressing roller 102 as an example of a second rotatable member.

The fixing device 1 introduces the recording material P into the heating nip N between the fixing roller 101 heated and kept at a predetermined surface temperature by halogen lamp heaters 103 and the pressing roller 102 which is press-contacted to the fixing roller 101 and which has elasticity. The recording material P is subjected to heat fixing of an unfixed toner image on its surface during nip-conveyance in the heating nip N.

The pressing roller 102 is press-contacted to the fixing roller 101 from below to form the heating nip N for the recording material P. The fixing roller 101 and the pressing roller 102 are connected by a gear train 166, with a variable center distance, provided at an opposite-side end portion, and are rotated codirectionally at the same surface speed. A motor 165 drives the fixing roller 101 and the pressing roller 102 via the gear train 166 to rotate these rollers in an arrow A direction at a predetermined speed.

Inside a core metal 101*a* of the fixing roller 101, the pair of the halogen lamp heaters 103 is disposed as a heat generating element and heats the fixing roller 101 from the inside. A surface temperature of the fixing roller 101 is detected by a thermistor 167 contactable to the fixing roller 101.

A temperature controller 169 turns on and off the halogen lamp heaters 103 on the basis of a detection temperature of the thermistor 167 to adjust electric power supplied to the halogen lamp heaters 103, thus controlling the surface temperature of the fixing roller 101 at a predetermined target temperature.

Inside a core metal 102*a* of the pressing roller 102, the halogen lamp heater 104 is disposed as a heat generating element and heats the pressing roller 102 from the inside. A surface temperature of the pressing roller 102 is detected by a thermistor 168 contactable to the pressing roller 102.

The temperature controller 169 turns on and off the halogen lamp heaters 104 on the basis of a detection temperature of the thermistor 168 to adjust electric power supplied to the halogen lamp heater 104, thus controlling the surface temperature of the pressing roller 102 at a predetermined target temperature.

On the surface of the core metal 101*a* of the fixing roller 101, a 300 μm-thick elastic layer of a silicone rubber is formed, and the surface of the elastic layer is covered with a parting layer of a fluorine-containing resin. On the surface of the core metal 102*a* of the pressing roller 102, a 100 μm-thick elastic layer of a silicone rubber is formed, and the surface of the elastic layer is covered with a parting layer of a fluorine-containing resin.

A raising and lowering cam 162 as an example of a moving mechanism is capable of integrally moving the pressing roller 102 and the halogen lamp heater 104 to a contact position in which the pressing roller 102 is contacted to the fixing roller 101 and a separation position in which the pressing roller 102 is separated from the fixing roller 101.

Both end portions of the pressing roller 102 are rotatably supported by bearings 130, and the bearings 130 are supported by an urging member 105 having a rotation shaft (rotational movement shaft) 111 as a rotation center (rotational movement center). The urging member 105 is urged upward by a coil spring 161 provided between an upper portion of the urging member 105 and a supporting member 170 with the rotation shaft 111 as the rotation center. A rotation end of the supporting member 170 is pushed up by the raising and lowering cam 162 to raise the pressing roller 102 via the coil spring 161, so that the pressing roller 102 is press-contacted to the fixing roller 101. As a result, the heating nip N is formed between the fixing roller 101 and the pressing roller 102.

A controller 164 rotates the raising and lowering cam 162 by actuating a motor 163 to control contact of the pressing roller 102 to the fixing roller 101 and separation of the pressing roller 102 from the fixing roller 101, thus effecting pressure application and pressure release (elimination). The controller 164 executes a discrimination as to whether the state is a pressure-applied state or a pressure-released state by detecting a phase angle of a sensor flag provided on a cam shaft of the raising and lowering cam 162.

The pressing roller 102 awaits the recording material while rotating at a predetermined speed in a state in which it is separated from the fixing roller 101.

As shown in (a) of FIG. 3, the fixing roller 101 and the pressing roller 102 are in a press-contact state during a normal operation such as copying or printing and have a function of fixing the toner image on the recording material by pressure and heat. However, the press-contact state of the fixing roller 101 and the pressing roller 102 is left standing for a long time, the pressed portion causes deformation. For this reason, when the image is fixed on the recording material subjected to the image formation immediately after the press-contact state is left standing for a long time, stripes are generated or uneven glossiness occurs on the surface of the fixed image with respect to a direction perpendicular to the recording material conveyance direction, thus causing image defect.

As shown in (b) of FIG. 3, during a sleep mode in which the image forming apparatus is ready for an image forming job or during power off, the pressure (application) is released by a separating operation for moving the pressing roller 102 away from the fixing roller 101. As a result, the fixing roller 101 and the pressing roller 102 are prevented from being subjected to load, so that the press-contact state is avoided from being left standing for a long time.

Incidentally, in recent years, with speed-up of the image forming apparatus, when a heat quantity of the fixing roller is taken by the conveyance of the recording material, insufficient fixing such as a so-called cold offset such that the toner image is transferred from the recording material onto the fixing roller can occur. For this reason, in the fixing device 1, the pressing roller 102 is also provided with the halogen lamp heater 104 as a countermeasure against a lowering in heat quantity by the recording material conveyance, and a constitution in which the pressing roller 102 can be separated from the fixing roller 101 is employed to solve a problem such as excessive temperature rise. For this purpose, in the fixing device 1, the halogen lamp heater 104 needs a bundle wire 106 and a connect or 107. The connector 107 of the halogen lamp heater 104 is connected with a connector 113 fixed at a frame side of the fixing device 1.

As shown in (a) of FIG. 3, in the case where the pressing roller 102 performs the contact and separation operation with respect to the fixing roller 101, the connector 107 of the halogen lamp heater 104 is fixed on a holding portion 113 at the frame side of the fixing device 1 and therefore bending (folding) action acts on the bundle wire 106. When the pressing roller 102 is contacted to and separated from the pressing roller 101, the bending action acts on the bundle wire 106. With respect to the bending action on the bundle wire 106, the bundle wire 106 absorbs an amount of deformation as a whole. However, in the case where a portion where rigidity is low is locally present in the bundle wire 106, almost deformation of the bundle wire 106 by the contacting and separating operation concentrates at the low-rigidity portion.

In such a constitution, fatigue of the bundle wire 106 due to the bending action during the contact and separation of the pressing roller 102 considerably impairs durability as the halogen lamp heater 104. The lifetime elongation of the fixing device 1 is strongly required, so that it is required that the durability against such a bending force is remarkably improved.

Therefore, in the following embodiments, the longitudinal direction in which the bundle wire of the crimp electrical connecting piece at the end portion of the halogen lamp heater 104 is flattened is brought near to a movement direction of the pressing roller 102, so that a degree of the bending of the bundle wire 106 with the movement of the pressing roller 102 is reduced and thus the durability is enhanced.

Embodiment 1

Parts (a) and (b) of FIG. 4 are illustrations of a structure of a connecting portion between a halogen lamp heater and a bundle wire. Parts (a) and (b) of FIG. 5 are illustrations of a change in attitude of a heater electrical connecting piece with contact and separation of a pressing roller. FIG. 6 is a graph showing a relationship between a tilt angle of a heater electrical connecting piece and a geometrical moment of inertia of a crimped bundle wire. Parts (a) and (b) of FIG. 7 are illustrations each showing a relationship between stress concentration and the geometrical moment of inertia of the crimped bundle wire. In FIG. 4, (a) is a schematic illustration of the halogen lamp heater 104, and (b) is an enlarged view of an engaging portion between the halogen lamp heater 104 and the bundle wire 106.

As shown in (a) of FIG. 4, a heater electrical connecting piece 108 as an example of the electrical connecting piece portion electrically connects the bundle wire 106 as an example of the electric wire to the halogen lamp heater 104 by crimping. The heater electrical connecting piece 108 is the crimp electrical connecting piece of a type in which the bundle wire 106 is distributed in a direction perpendicular to a crimping direction during the crimping.

As shown in FIG. 2, the halogen lamp heater 104 of the pressing roller 102 includes the bundle wire 106 and the connector 107. The connector 107 is inserted into and held by the holding portion 113 at the frame side of the fixing device 1. Incidentally, the holding portion 113 is fixed at a position where it is not rotationally moved by the urging member 105.

As shown in (b) of FIG. 4, the halogen lamp heater 104 of the pressing roller 102 and the bundle wire 106 are engaged by the heater electrical connecting piece 108. The heater electrical connecting piece 108 engages an electric energy supplying electrical connecting piece of the halogen lamp heater 104 and the bundle wire 106 by using the crimp electrical connecting piece.

The halogen lamp heater 104 is disposed in parallel to the rotation center axis of the pressing roller 102. An end cap 114 as a supporting portion, provided at the end portion of the halogen lamp heater 104, for supporting the electric energy supplying electrical connecting piece is fixed at the end portion of the halogen lamp heater 104. The heater electrical connecting piece 108 is held in a through hole of the end cap 114 with play (clearance) and therefore autonomously adjusts its attitude, in a range of the play, toward a direction in which a stress distribution of the bundle wire 106 with the movement of the pressing roller 101 at the connecting portion with the heater electrical connecting piece 108 is averaged (uniformized). As a result, a part of the bundle wire 106 is prevented from constituting a starting point of fatigue breakdown (fracture) due to stress concentration.

The heater electrical connecting piece 108 is flattened integrally with the bundle wire 106 under pressure by using a crimping tool and thereafter is inserted into the through hole of the end cap 114, thus being held in the through hole in a rotation-constrained state. The end cap 114 and the halogen lamp heater 104 are fixed busing a ceramic adhesive. A contour of the heater electrical connecting piece 108 after being flattened and engaged is about 1 mm in width with respect to a widthwise direction in which it is flattened and about 3 mm in length with respect to a longitudinal direction in which it is flattened and enlarged. Further, in a state after the engagement, a cross section of the bundle wire 106 held by the heater electrical connecting piece 108 has a widthwise direction which is a flattened direction of the heater electrical connecting piece 108 and has a longitudinal direction which is the direction in which the bundle wire 106 is flattened and enlarged.

The heater electrical connecting piece 108 is held in the through hole which is formed in the end cap 114 and which has a rectangular cross section. In the through hole of the end cap 114, rotation of the heater electrical connecting piece 108 is prevented in a state in which the longitudinal direction of the heater electrical connecting piece 108 is a vertical direction and the widthwise direction of the heater electrical connecting piece 108 is a horizontal direction. The end cap 114 is provided with a rotation preventing portion 114*a*. The rotation preventing portion engages an opening of a position regulating member 112, so that the rotation of the end cap 114 is prevented. An angular attitude of the halogen lamp heater 104 is regulated by the rotation preventing portion 114*a* so that the longitudinal direction of the cross section of the bundle wire flattened by the heater electrical connecting piece 108 coincides with the contact and separation direction of the pressing roller 102.

As shown in (a) of FIG. 3, the halogen lamp heater 104 is disposed in parallel to the rotation center axis of the pressing roller 102. The position regulating member 112 and the rotation preventing portion 114 regulate the direction of the heater electrical connecting piece 108 so that an angle formed between the longitudinal direction of the cross section of the crimped bundle wire 106 and the movement direction of the pressing roller 102 is kept constant.

As shown in (a) of FIG. 5, the position of the heater electrical connecting piece 108 in a state in which the pressing roller 102 is separated from the fixing roller 101 is P1. The position of the heater electrical connecting piece 108 in a state in which the pressing roller 102 is press-contacted to the fixing roller 101 is P2. Even when the halogen lamp heater 104 is moved upward and downward with the rotation shaft 111 as the center, the angular attitude of the heater electrical connecting piece 108 is kept substantially constant so that the longitudinal direction of the cross section of the bundle wire 106 held by the heater electrical connecting piece 108 coincides with a raising and lowering direction. This is because, as shown in (a) of FIG. 4, the rotational attitude of the halogen lamp heater 104 is regulated by the rotation preventing member 114 and the position regulating member 112.

For this reason, an angle formed between a tangential direction (roller contact and separation direction C) of a circular locus of the heater electrical connecting piece 108 with the rotation shaft 111 as the center and the longitudinal direction of the heater electrical connecting piece 108 is approximately zero degrees. When the rotation angle of the rotation shaft 111 by the contact and separation of the pressing roller 102 is α, an angle formed between the longitudinal direction of the heater electrical connecting piece 108 during the separation (P1) and the longitudinal direction of the heater electrical connecting piece 108 during the contact (P2) is α.

However, with the rotation at the angle α, the electrical connecting piece cross section is tilted by the angle α and therefore even when a tilt angle at a starting point of the movement is 0 deg., at an end point of the movement, the angle formed between the longitudinal direction of the crimped cross section of the bundle wire 106 and the movement direction of the pressing roller 102 by the raising and lowering cam 162 is α. That is, the geometrical moment of inertia is somewhat lowered. Therefore, the direction of the crimped cross section of the bundle wire (electrical connecting piece cross section) is set, by taking the lowering into consideration, so that a maximum angle of angles between itself and the tangential direction of the movement at each time during the movement process is 45 degrees or less.

Here, it is assumed that the bundle wire 106 is a cantilever such that the heater electrical connecting piece 108 is a fixed end and a lead W is exerted at a free end. A warp degree (flexure amount) of the bundle wire 106 is proportional to the load W and is inversely proportional to the geometrical moment of inertia and Young's modulus of the bundle wire 106. Further, a maximum bending stress acts on the connecting portion between the bundle wire 106 and the heater electrical connecting piece 108. For this reason, even if the bundle wire 106 has the same cross sectional shape from its end to its base portion, the stress concentration occurs at the connecting portion between the heater electrical connecting piece 108 and the bundle wire 106, so that the fatigue breakdown is liable to occur by repetitive load application.

The load W acting on the cantilever is determined by the position of the connector 107, the length of the bundle wire 106 and an amount of the movement of the pressing roller 102 and is constant. The Young's modulus is a characteristic value of the bundle wire 106 and there is constant if the bundle wire 106 is formed of the same material.

However, the geometrical moment of inertia varies depending on the cross sectional shape and angular attitude of the bundle wire 106. Easiness of warp (deformation) of the bundle wire 106 can be regulated by the geometrical moment of inertia. The geometrical moment of inertia of the bundle wire 106 at the connecting portion between the heater electrical connecting piece 108 and the bundle wire 106 is made higher than that at an adjacent portion which is not crimped, the stress concentration at the connecting portion can be avoided and the warp can be distributed over the whole bundle wire 106.

As shown in FIG. 6, in the case where the contour of the heater electrical connecting piece 108 is 3 mm in length with respect to the longitudinal direction and 1 mm in width with respect to the widthwise direction, the geometrical moment of inertia of the bundle wire 106 at the connecting portion between the heater electrical connecting piece 108 and the bundle wire 106 was obtained by calculation. As in this embodiment (Embodiment 1), in the case where the angle formed between the contact and separation direction C and the longitudinal direction of the heater electrical connecting piece 108 is regulated at 0 deg., the geometrical moment of inertia is maximum. When the angle formed between the longitudinal direction of the heater electrical connecting piece 108 and the contact and separation direction C is increased, the geometrical moment of inertia of the bundle wire 106 is gradually lowered and when the angle formed between the contact and separation direction C and the longitudinal direction of the heater electrical connecting piece 109 is 90 deg., the geometrical moment of inertia is decreased to ⅙ of the maximum.

As shown in FIG. 5, the heater electrical connecting piece 108 is the crimp electrical connecting piece of a type in which the bundle wire 106 as the example of the electric wire is distributed in the movement direction of the pressing roller 102 in the process in which the bundle wire 106 is crimped with respect to the direction perpendicular to the movement direction of the pressing roller 102. The heater electrical connecting piece 108 is, in the cross section perpendicular to its longitudinal direction, flattened so as to divide the bundle wire into those in two (upper and lower) spaces by surrounding the bundle wire with a metal piece. For that reason, in this embodiment, the geometrical moment of inertia of the bundle wire 106 at the boundary between the bundle wire 106 and the heater electrical connecting piece 108 can have a larger value than those in FIG. 6 with respect to the longitudinal direction of the crimped bundle wire 106.

As shown in (a) of FIG. 7, in the case where the bundle wire 106 is crimped by the heater electrical connecting piece 108 so as to be enlarged in the contact and separation direction, the geometrical moment of inertia of the bundle wire 106 at the connecting portion with the heater electrical connecting piece 108 is maximum, so that the bundle wire 106 at the connecting portion is not readily deformed. In the case where the geometrical moment of inertia is large, the stress concentration at the bundle wire 106 at the connecting portion is avoided, so that the deformation of the bundle wire 106 by the contact operation of the pressing roller 102 is absorbed by the whole bundle wire 106. As a result, a deformation angle of the bundle wire 106 at the boundary portion between the bundle wire 106 and the heater electrical connecting piece 108 is decreased, so that the stress locally exerted on the boundary portion between the bundle wire 106 and the heater electrical connecting piece 108 can be alleviated.

As shown in (b) of FIG. 7, in the case where the bundle wire 106 is crimped by the heater electrical connecting piece 108, so as to be flattened in the contact and separation direction, the geometrical moment of inertia of the bundle wire 106 at the connecting portion with the heater electrical connecting piece 108 is minimum, so that the bundle wire 106 at the connecting portion is liable to be deformed. In the case where the geometrical moment of inertia is large, the deformation of the bundle wire 106 by the contact operation of the pressing roller 102 locally occurs at the boundary portion between the bundle wire 106 and the heater electrical connecting piece 108 and therefore a large bending action acts on the bundle wire 106 to exert the stress on the bundle wire 106.

In a state in which the length of the bundle wire is 100 mm and the connector 107 is fixed, the pressing roller 102 was moved by 7 mm in the contact and separation direction C. As shown in (b) of FIG. 7, when the angle formed between the contact and separation direction C and the longitudinal direction of the heater electrical connecting piece 108 is regulated at 90 deg., the deformation angle at the boundary portion between the bundle wire 106 and the heater electrical connecting piece 108 was about 5 deg. On the other hand, as shown in (a) of FIG. 7, when the angle formed between the contact and separation direction C and the longitudinal direction of the heater electrical connecting piece 108 is regulated at 0 deg., the deformation angle at the boundary portion between the bundle wire 106 and the heater electrical connecting piece 108 was about 0.6 deg. Compared with the case of the regulation at 90 deg., the deformation angle at the boundary portion between the bundle wire 106 and the heater electrical connecting piece 108 can be suppressed to 12%.

Incidentally, in this embodiment, the angle formed between the contact and separation direction C and the longitudinal direction of the heater electrical connecting piece 108 is regulated at 0 deg., but is not limited to 0 deg., in the present invention. When the angle is regulated at (45 deg.–$\alpha$) compared with a condition of 90 deg. at which the deformation amount is largest, even in any attitude during the contact and separation operation of the pressing roller 102, a deformation amount suppressing effect which is not less than two times that under the condition of 90 deg. can be obtained.

Further, in this embodiment, the constitution in which the pressing roller 102 is rotationally moved about the rotation shaft 111 as the rotation center is employed but the movement of the pressing roller 102 is not limited to the rotational movement but may also be, e.g., translation (parallel displacement). At this time, $\alpha$ is 0 deg., and therefore when the angle formed between the contact and separation direction C and the heater electrical connecting piece 108 is regulated at 45 deg. or less, the deformation amount suppressing effect which is not less than two times is obtained.

Further, in this embodiment, a heat source for the pressing roller 102 is not limited to only the halogen lamp heater 104. When the heat source has the bundle wire 106, the heat source may also be an electromagnetic induction coil assembly. Further, the connector 107 may only be required to be fixed at the frame side of the fixing device 1 and may also employ, e.g., a constitution in which the connector 107 is fastened to the electrical connecting piece with a screw.

Embodiment 2

Parts (a) and (b) of FIG. 8 are perspective views of a wiring structure at a roller end portion in Embodiment 2. Parts (a) and (b) of FIG. 9 are illustrations of a structure of a connecting portion between a halogen lamp heater and a bundle wire in Embodiment 2. FIG. 10 is an illustration of a change in attitude of a heater electrical connecting piece with contact and separation of a pressing roller in Embodiment 2.

FIG. 2 has the same constitution as that in Embodiment 1 except that two halogen lamp heaters are provided in parallel at the rotation center of the pressing roller. Therefore, constituent elements (members) common to FIGS. 3 and 4 (Embodiment 1) and FIGS. 8 and 9 (Embodiment 2) are represented by the same reference numerals (symbols) as those in FIGS. 3 and 4 and will be omitted from redundant description.

Due to speed-up of the image forming apparatus and an increase in type of the recording material to be met in recent years, in the case where sheets of the recording material having a small size with respect to the widthwise direction perpendicular to the conveyance direction were continuously fixed, excessive temperature rise in non-sheet-passing regions of the fixing roller and the pressing roller were liable to occur. Further, on the other hand, when temperature lowering in the non-sheet-passing regions occurs, there arises a possibility that lateral shift creases are generated at a trailing end of the recording material at the time of fixing a thin recording material. With respect to such a problem of an electrical connecting piece distribution in the longitudinal direction of the fixing roller and the pressing roller, in the above-described JP-A 2006-184366, the problem is intended to be solved by controlling the pair of halogen lamp heaters having different heat generation amount distribution characteristics.

As shown in (a) of FIG. 8, the halogen lamp heater 104 is disposed in parallel to the rotation center axis of the pressing roller 102. The position regulating member 112 and the rotation preventing portion 114 regulate the direction of the heater electrical connecting piece 108 so that an angle formed between the longitudinal direction of the cross section of the crimped bundle wire 106 and the movement direction of the pressing roller 102 is kept constant.

The position regulating member 112 positions and holds bundle wires 106 at an angle of rotation so that the pressing roller 102 moves along the longitudinal direction of cross sections of the bundle wires 106 crimped by heater electrical connecting pieces 108*a* and 108*b*. The rotation preventing portion 114*a* of the end cap 114 is engaged in the opening of the position regulating member 112, so that rotation of the end cap 114 is prevented. Even in the heating nip formation state and in the heating nip elimination state, the heater electrical connecting piece 108*a* is subjected to the position regulation by the rotation preventing portion 114*a* and the position regulating member 112. For this reason, as shown in FIG. 10, an angle formed between a tangential direction (roller contact and separation direction C) of a circular locus of the heater electrical connecting piece 108*a* with the rotation shaft 111 as the center and the longitudinal direction of the cross section of the heater electrical connecting piece 108*a* is approximately zero degrees. Further, an angle formed between a tangential direction (roller contact and separation direction C) of a circular locus of the heater electrical connecting piece 108*c* with the rotation shaft 111 as the center and the longitudinal direction of the cross section of the heater electrical connecting piece 108*c* is approximately zero degrees.

As shown in (a) of FIG. 8, when the pressing roller 102 is press-contacted to the fixing roller 101, the heating nip for the recording material is formed between the pressing roller 102 and the fixing roller 101. On the other hand, as shown in (b) of FIG. 8, when the pressing roller 102 is separated from the fixing roller 101, the heating nip between the pressing roller 102 and the fixing roller 101 is eliminated.

As shown in (a) of FIG. 9, the pressing roller 102 contains the two halogen lamp heaters 104*a* and 104*c*. Further, as shown in (b) of FIG. 9, the halogen lamp heaters 104*a* and 104*b* are engaged with the bundle wires 106 by the heater electrical connecting pieces 108*a* and 108*c*, respectively. The bundle wires 106 as the example of the electric wire are electrically connected with the heater electrical connecting pieces 108*a* and 108*c*.

In this embodiment (Embodiment 2), the halogen lamp heater 104*a* having a high heat generating region at a central portion and the halogen lamp heater 104*c* having the high heat generating region at end portions are incorporated in combination in the pressing roller 102 (FIG. 8). Depending on the status, the halogen lamp heaters 104*a* and 104*c* are independently turned on and off, so that the temperature distribution of the pressing roller 102 with respect to the longitudinal direction is controlled in a central-portion high temperature pattern or an end-portion high temperature pattern.

The positional relation of the heater electrical connecting pieces 108*a* and 108*c* as the example of the electrical connecting piece portion relative to the rotation shaft of the pressing roller 102 as the example of the second rotatable member is fixed. The heater electrical connecting pieces 108*a* and 108*c* crimps (flattens) the bundle wires 106 to ensure electrical connection with the halogen lamp heaters 104*a* and 104*c* as the example of the heating device.

As shown in FIG. 10, in this embodiment, the heater electrical connecting pieces 108*a* and 108*c* of the halogen lamp heaters 104*a* and 104*c* are rotationally moved with the rotation shaft 111 as the center. The rotation shaft 111, the heater electrical connecting piece 108*a* and the heater electrical connecting piece 108*c* are disposed on the same (rectilinear) line (substantially) perpendicular to the movement direction. For this reason, as shown in (a) of FIG. 8, the length of the bundle wire 106 from the heater electrical connecting piece 108*a* to the connector 107 and the length of the bundle wire 106 from the heater electrical connecting piece 108*c* to the connector 107 are the substantially same.

In a state in which the pressing roller 102 is separated from the fixing roller 101, the heater electrical connecting piece position of the halogen lamp heater 104*a* is P1, and the heater electrical connecting piece position of the halogen lamp heater 104*c* is Q1. On the other hand, in a state in which the pressing roller 102 is press-contacted to the fixing roller 101, the heater electrical connecting piece position of the halogen lamp heater 104*a* is P2, and the heater electrical connecting piece position of the halogen lamp heater 104*c* is Q2. Even when the halogen lamp heaters 104*a* and 104*c* are moved upward and downward with the rotation shaft 111 as the center, the angular attitude of the heater electrical connecting piece 108 is kept substantially constant so that the longitudinal direction of the cross sections of the bundle wires 106 (FIG. 9) held by the heater electrical connecting pieces 108*a* and 108*c* coincide with a raising and lowering direction.

Incidentally, as shown in (b) of FIG. 9, when the halogen lamp heaters 104*a* and 104*c* are disposed in parallel at adjacent positions, a spacing therebetween becomes narrow to constitute a hindrance to the crimping operation of the bundle wires 106. In such a case, the heater electrical connecting pieces 108*a* and 108*c* may also be disposed back to back. Each of the heater electrical connecting pieces 108*a* and 108*c* crimps the bundle wire 106 by inwardly bending an associated metal piece so as to surround the cross section of the bundle wire 106 from the outside, so that operativity of the crimping can be improved.

In the above-described embodiments, the constitution in which the pressing roller 102 is contacted to and separated from the fixing roller 101 is described but the present invention is not limited to such a relationship between the fixing roller and the pressing roller. For example, also between the fixing roller as a fixing member and an external heating member, incorporating the heater therein, for heating the fixing roller in contact to the surface of the fixing roller, the effect of the present invention can be obtained by applying the present invention. That is, in a constitution in which the external heat member is contacted to and separated from the fixing roller, also with respect to the relationship between the electrical connecting piece of the inner heater of the external heating member and the movement direction of the external heating member, by employing the constitution of the present invention, the effect of the present invention can be obtained.

Further, also with respect to a roller member, other than the pressing roller, which includes the heater at its inside and which is used for stretching the belt member at its outer peripheral surface, the effect of the present invention can be obtained by employing the constitution of the present invention.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 101455/2011 filed Apr. 28, 2011, which is hereby incorporated by reference.

What is claimed is:

1. An image heating apparatus comprising:

a first rotatable member and a second rotatable member which form a nip in which an image on a recording material is to be heated;

a heater provided in said second rotatable member;

a moving mechanism configured to integrally move said second rotatable member and said heater between a contact position in which said second rotatable member contacts said first rotatable member and a separation position in which said second rotatable member is separated from said first rotatable member;

an electrical connecting piece configured to electrically connect an electrical energy supplying portion of said heater and an electrical wire under the application of pressure, wherein the longitudinal direction of said electrical connecting piece is set so that the angle formed between the longitudinal direction of said electrical connecting piece and a movement direction of said electrical connecting piece during an operation by said moving mechanism is 45 degrees or less; and a regulating member configured to regulate a direction of said electrical connecting piece.

2. An image heating apparatus comprising:

a first rotatable member and a second rotatable member which form a nip in which an image on a recording material is to be heated;

a heater provided in said second rotatable member;

a moving mechanism configured to integrally move said second rotatable member and said heater between a contact position in which said second rotatable member contacts said first rotatable member and a separation position in which said second rotatable member is separated from said first rotatable member;

an electrical connecting piece configured to electrically connect an electrical energy supplying portion of said heater and an electrical wire under the application of pressure, wherein the longitudinal direction of said electrical connecting piece is set so that the angle formed between the longitudinal direction of said electrical connecting piece and a movement direction of said electrical connecting piece during an operation by said moving mechanism is 45 degrees or less, wherein said electrical connecting piece is a crimp electrical connecting piece.

3. An image heating apparatus comprising:

a first rotatable member and a second rotatable member which form a nip in which an image on a recording material is to be heated;

a heater provided in said second rotatable member;

a moving mechanism configured to integrally move said second rotatable member and said heater between a contact position in which said second rotatable member contacts said first rotatable member and a separation position in which said second rotatable member is separated from said first rotatable member;

an electrical connecting piece configured to electrically connect an electrical energy supplying portion of said heater and an electrical wire under the application of pressure, wherein the longitudinal direction of said electrical connecting piece is set so that the angle formed between the longitudinal direction of said electrical connecting piece and a movement direction of said electrical connecting piece during an operation by said moving mechanism is 45 degrees or less;

a supporting portion, provided at an end portion of said heater; and a through hole, provided in said supporting portion, through which said electrical energy supplying portion is to be passed, wherein said electrical connecting piece is provided in said through hole.

4. An image heating apparatus comprising:

a first rotatable member and a second rotatable member which form a nip in which an image on a recording material is to be heated;

a heater provided in said second rotatable member;

a moving mechanism configured to integrally move said second rotatable member and said heater between a contact position in which said second rotatable member contacts said first rotatable member and a separation position in which said second rotatable member is separated from said first rotatable member;

an electrical connecting piece configured to electrically connect an electrical energy supplying portion of said heater and an electrical wire under the application of pressure, wherein the longitudinal direction of said electrical connecting piece is set so that the angle formed between the longitudinal direction of said electrical connecting piece and a movement direction of said electrical connecting piece during an operation by said moving mechanism is 45 degrees or less;

a second heater provided in said second rotatable member; and a second electrical connecting piece configured to electrically connect an electrical energy supplying portion of said second heater and a second electrical wire, wherein the longitudinal direction of said second electrical connecting piece is set so that the angle formed between a longitudinal direction of said second electrical connecting piece and a movement direction of said second electrical connecting piece during an operation by said moving mechanism is 45 degrees or less.

5. An image heating apparatus according to claim 1, wherein said heater is disposed parallel to a rotation center axis of said second rotatable member, and wherein said electrical connecting piece is held in a state in which rotation of said electrical connecting piece is constrained by an end portion of said heater.

6. An image heating apparatus according to claim 2, wherein said heater is disposed parallel to a rotation center axis of said second rotatable member, and wherein said electrical connecting piece is held in a state in which rotation of said electrical connecting piece is constrained by an end portion of said heater.

7. An image heating apparatus according to claim 3, wherein said heater is disposed parallel to a rotation center axis of said second rotatable member, and wherein said electrical connecting piece is held in a state in which rotation of said electrical connecting piece is constrained by an end portion of said heater.

8. An image heating apparatus according to claim 4, wherein said heater is disposed parallel to a rotation center axis of said second rotatable member, and wherein said electrical connecting piece is held in a state in which rotation of said electrical connecting piece is constrained by an end portion of said heater.

9. An image heating apparatus according to claim 1, wherein the electrical wire is connected to a connector or fixed at a position apart from said moving mechanism.

10. An image heating apparatus according to claim 2, wherein the electrical wire is connected to a connector fixed at a position apart from said moving mechanism.

11. An image heating apparatus according to claim 3, wherein the electrical wire is connected to a connector fixed at a position apart from said moving mechanism.

12. An image heating apparatus according to claim 4, wherein the electrical wire is connected to a connector fixed at a position apart from said moving mechanism.

13. A fixing apparatus comprising:

a rotatable fixing member configured to fix a toner image on a recording material at a nip;

a heating unit including a rotatable heating member and a heater provided in said heating member and configured to heat said heating member;

an electrical energy supplying portion configured to supply electrical energy to said heater;

an electrical connecting portion configured to connect an end portion of an electrical wire connected to said heater and an end portion of an electrical wire connected to said electrical energy supplying portion by crimping an overlapped portion between the end portions of said electrical wires; and a moving mechanism configured to move said heating unit relative to said fixing member and said electrical energy supplying portion between a heating position in which said fixing member is heated by said heating member and a stand-by position in which said heating member is retracted from said fixing member in a moving direction, wherein an angle between the moving direction and a longitudinal direction of the overlapped portion is 45 degree or less.

14. A fixing apparatus according to claim 13, wherein said moving mechanism rotates said heating unit around a rotational axis so that the angle between tangential directions of a rotation of said heating unit around the rotational axis during a moving operation by said moving mechanism and the longitudinal direction of the overlapped portion is 45 degree or less.

15. A fixing apparatus according to claim 13, further comprising a holding portion configured to hold said electrical connecting portion, and a regulating member configured to regulate a longitudinal direction of said electrical connecting portion by engaging with said holding portion.

16. A fixing apparatus according to claim 14, further comprising a holding portion configured to hold said electrical connecting portion and a regulating member configured to regulate rotation of said electrical connecting portion during the moving operation.

17. A fixing apparatus according to claim 13, wherein said fixing member and said heating member cooperatively form a fixing nip at which the toner image is fixed on the recording material.

18. A fixing apparatus according to claim 13, further comprising a pressing member forming a fixing nip at which the toner image is fixed on the recording material cooperatively with said fixing member, wherein said heating member heats said fixing member by contacting to an outer surface of said fixing member.

19. A fixing apparatus according to claim 13, further comprising a second heater provided in said heating member and a second electrical connecting portion configured to connect an end portion of a third electrical wire connected to said second heater and an end portion of a fourth electrical wire connected to said electrical energy supplying portion by crimping a second overlapped portion between the end portions of said third and fourth electrical wires, wherein the angle between the moving direction and a longitudinal direction of the second overlapped portion is 45 degree or less.

* * * * *